US005729830A

United States Patent [19]

Luhtala

[11] Patent Number: 5,729,830

[45] Date of Patent: Mar. 24, 1998

[54] PROTECTION HEADGEAR

[76] Inventor: Anti Juhani Luhtala, 2774 S. Ocean Blvd. #106, Palm Beach, Fla. 33480

[21] Appl. No.: 696,631

[22] Filed: Aug. 14, 1996

[51] Int. Cl.[6] ..... A42B 3/00

[52] U.S. Cl. ..... 2/2.5; 2/410; 2/195.1; 2/195.6; 2/200.1

[58] Field of Search ..... 2/2.5, 410, 411, 2/412, 5, 6.6, 422, 423, 172, 205, 209.13, 175.4, 195.1, 195.5, 195.6, 200.1

[56] References Cited

U.S. PATENT DOCUMENTS

| | | | |
|---|---|---|---|
| 1,187,656 | 6/1916 | Sargent | 2/412 |
| 1,787,378 | 12/1930 | Hollenbeck | 2/195.1 |
| 2,615,168 | 10/1952 | Tannenbaum | 2/195.5 |
| 2,926,356 | 3/1960 | Taylor | 2/412 |
| 3,018,210 | 1/1962 | Frieder et al. | 2/2.5 |
| 3,061,839 | 11/1962 | Foster | 2/2.5 |
| 3,133,289 | 5/1964 | Lipschultz | 2/195.5 |
| 3,344,437 | 10/1967 | Greene | 2/195.6 |
| 3,634,889 | 1/1972 | Rolsten | 2/2.5 |
| 4,951,319 | 8/1990 | Phillips, Jr. et al. | 2/172 |
| 4,982,449 | 1/1991 | Finkelstein | 2/200.1 |
| 5,481,760 | 1/1996 | Wood, Jr. | 2/195.5 |
| 5,544,367 | 8/1996 | March, II | 2/411 |

FOREIGN PATENT DOCUMENTS

| | | | |
|---|---|---|---|
| 2214405 | 9/1989 | United Kingdom | 2/2.5 |

*Primary Examiner*—Michael A. Neas

[57] ABSTRACT

A protection headgear against ballistic projectiles for use where a helmet is in-appropriate or where the headgear is wanted not to differ in appearance from conventional headgear and the problem has been the lack of a proper headgear. The problem is solve by providing a protection headgear (1), wherein the protection structures are compose of flexible protective and damping layers (20–25), the headgear's (9) outer and inner surface materials (5, 6, 53; 48, 47, 54, 61) including protection structures which may be removable (15, 33, 39), a vizor (4) being able to comprise the protection structure.

5 Claims, 6 Drawing Sheets

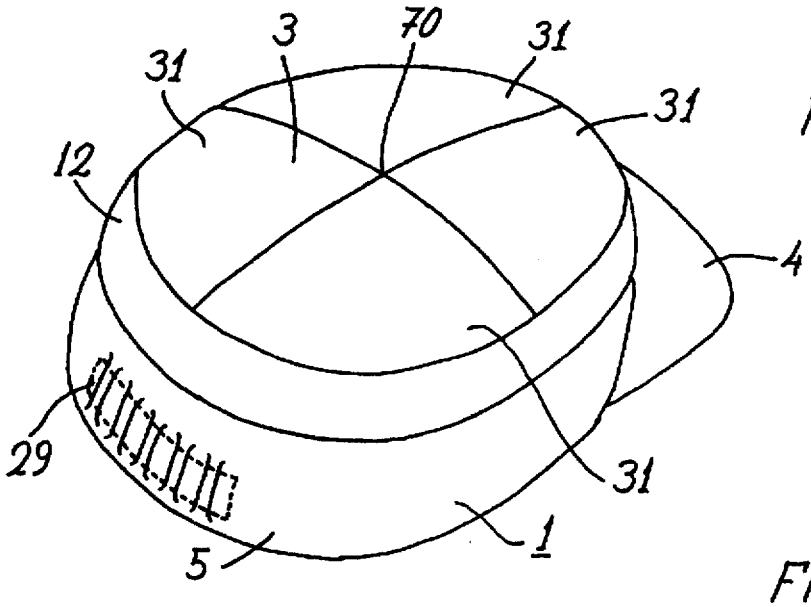
FIG.4
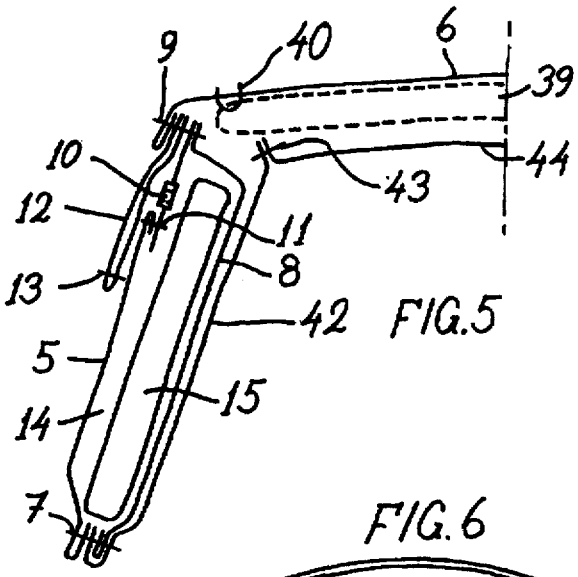
FIG.5
FIG.7
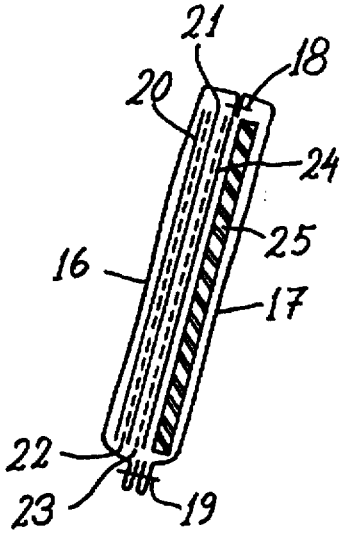
FIG.6
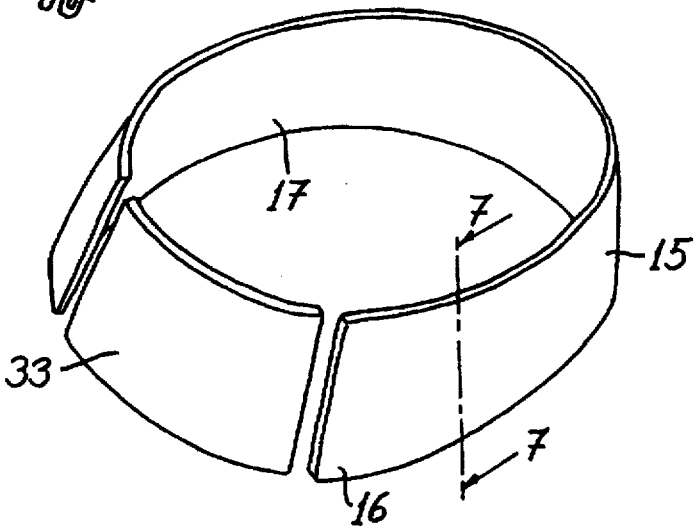

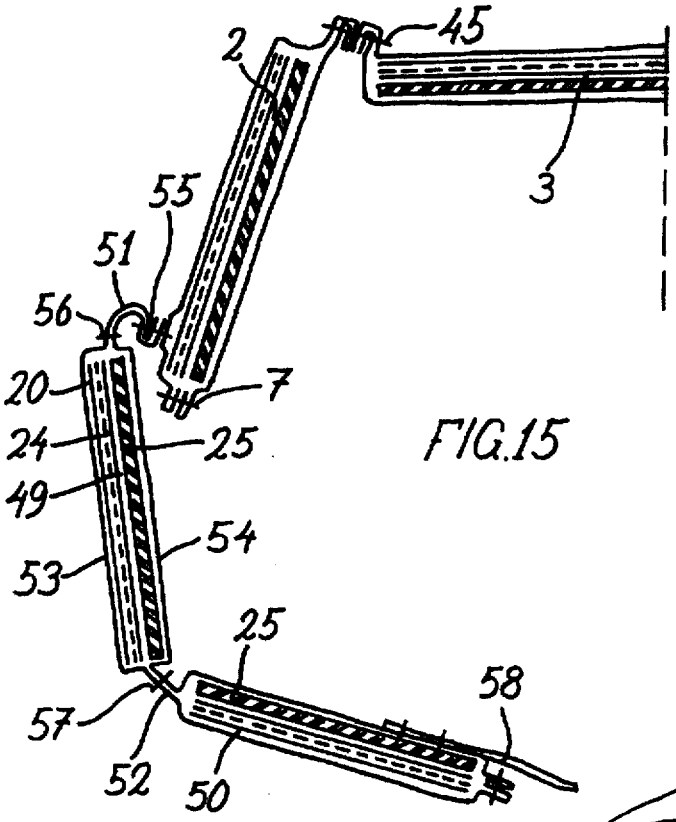
FIG.15
FIG.16
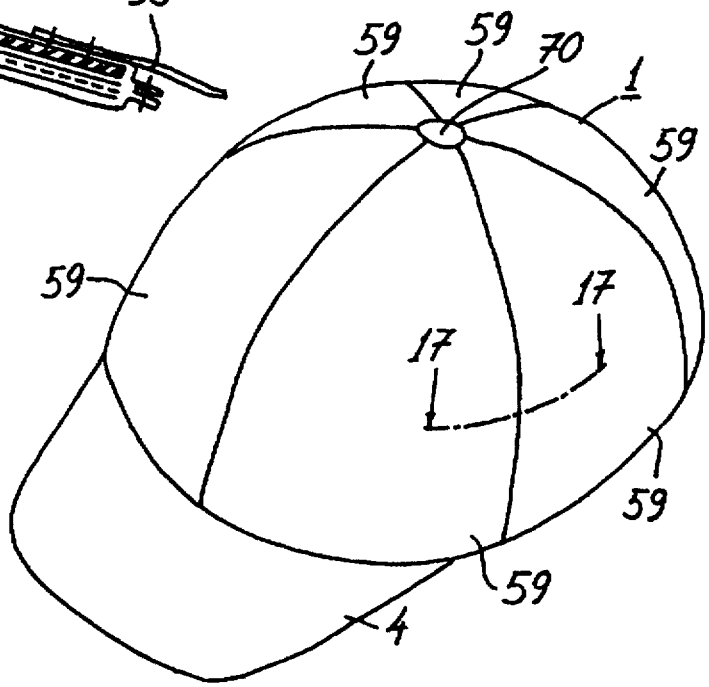
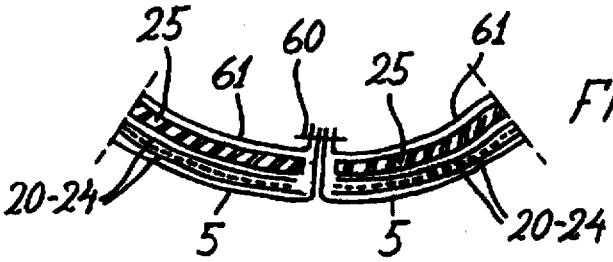
FIG.17

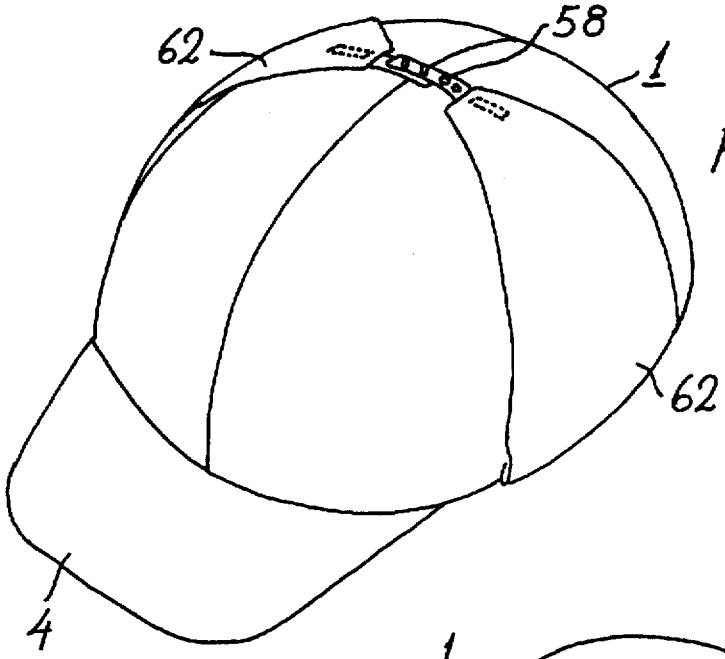
FIG.18
FIG.19
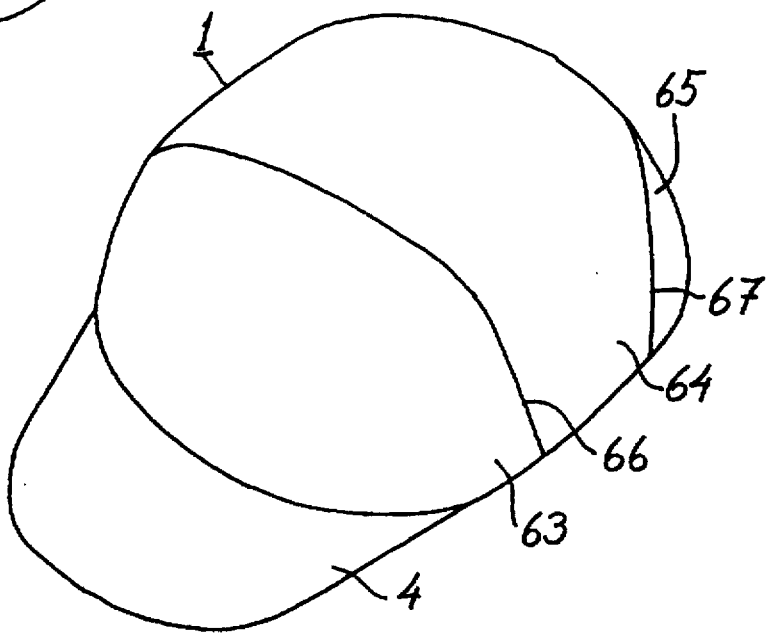
FIG.20
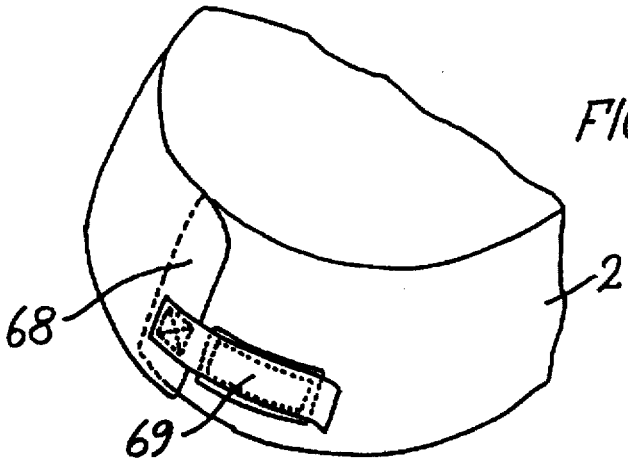

PROTECTION HEADGEAR

FIELD OF THE INVENTION

This invention relates to a protection headgear. Protection means here the protection against influence of bullets, splinters and projectiles.

BACKGROUND OF THE INVENTION

Formerly as a protection headgear there is known of course the military helmet that gives quite a good protection against the influence of bullets, splinters and the kind. One drawback of the helmet, its great weight, has been reduced by technical development and by shifting over to use composite materials. Another drawback of the helmet, its improperness for peacetime civilian use, cannot be remedied.

In civil life there arise situations in which there exists a danger of head injuries with fatal consequences. Those situations may arise e.g. while hunting together at the same time in a greater team, which leads to risk of erroneous or accidental shots or ricochets. The situations may be related to dangers of a profession, as is the case encountered by police or security men. Especially in the case of just mentioned professions, one necessary feature of the protection headgear may be such that outsiders can't detect the protection in order to maintain a calm and peaceful situation.

The need for a protection headgear especially by the policemen is shown by FBI's research covering the years 1980–1987. During that time 115 police officers were lethally shot, though they were wearing ballistic resistant soft garment. 51% of the victims died of shots hit in the head.

SUMMARY OF THE INVENTION

This invention provides a protection headgear for civil use and for the use where the protective feature of the headgear exists without unnecessary outwardly differing from conventional headgears. In order to achieve this, the protection headgear of the invention has been given the characteristic features described in the claims.

The protection headgear of the invention is light-weight, so wearing it does not cause an additional strain for the wearer as compared to conventional headgears.

The protection headgear of the invention is comfortable, because its flexibility allows it to adjust to the shape and size of the wearer's head (and hair). Self-adjustment to size may further be improved by size adjustment means of the protection headgear.

The protection headgear of the invention may be manufactured with a feature -that it, without a closer investigation, can't be distinguished from ordinary headgears.

The protection headgear of the invention may be elegantly designed and manufactured from proper materials as far as to the color in order to satisfy the tastes and/or feature demands of each customer group.

The protection headgear of the invention may be arranged such that the protection or armouring may easily be removed from it and again returned. In this kind of embodiment the protection headgear may be used as an ordinary headgear.

When an embodiment of the protection headgear of the invention is in form of a cap, the vizor may be utilized for providing an additional protection for face region of the wearer.

When an embodiment of the protection headgear of the invention is provided with foldable additional protection means, there is achieved protection for the areas of the wearer's neck, ears, temples and cheeks.

Other advantages and features of the protection headgear of the invention will become clear from the following detailed description.

DESCRIPTION OF THE DRAWINGS

A detailed description of the invention is made referring to the drawings, in which:

FIG. 4 is, like the FIG. 3, a rear perspective view of the protection headgear according to the invention, now of a modified embodiment.

FIG. 5 is a sectional view of the protection headgear seen in the direction of the arrows A—A in the FIG. 1.

FIG. 6 is a view of protective shields to be included in the protection headgear of the FIGS. 1 and 2.

FIG. 7 is a sectional view of the protective shield, seen in the direction of the arrows B—B in the FIG. 6 and in a slightly enlarged scale.

FIG. 15 is a sectional view, seen in the direction of the arrows F—F in the FIG. 13 and in a slightly enlarged scale.

FIG. 16 is a front perspective view of the protection headgear according to the invention, now of a modified embodiment.

FIG. 17 is a detail sectional view, seen in the direction of the arrows G—G in the FIG. 16 and in a slightly enlarged scale.

FIG. 18 is a perspective view of the protection headgear of the FIG. 16, provided with foldable additional protection means.

FIG. 19 is a front perspective view of the protection headgear according to the invention, of still another modified embodiment.

FIG. 20 is a view of a detail in the protection headgear according to the invention.

DETAILED DESCRIPTION OF THE INVENTION

To be noticed generally, especially in the sectional views, separate fabrics and/or layers are shown exaggerated apart from each other to clarify the figures. For the same reason the stitched seams of the fabrics and layers and the cuffs are shown exaggerated apart from each other. In practice and in reality the fabrics and the layers lie tightly and flexibly against each other.

Figure 1:
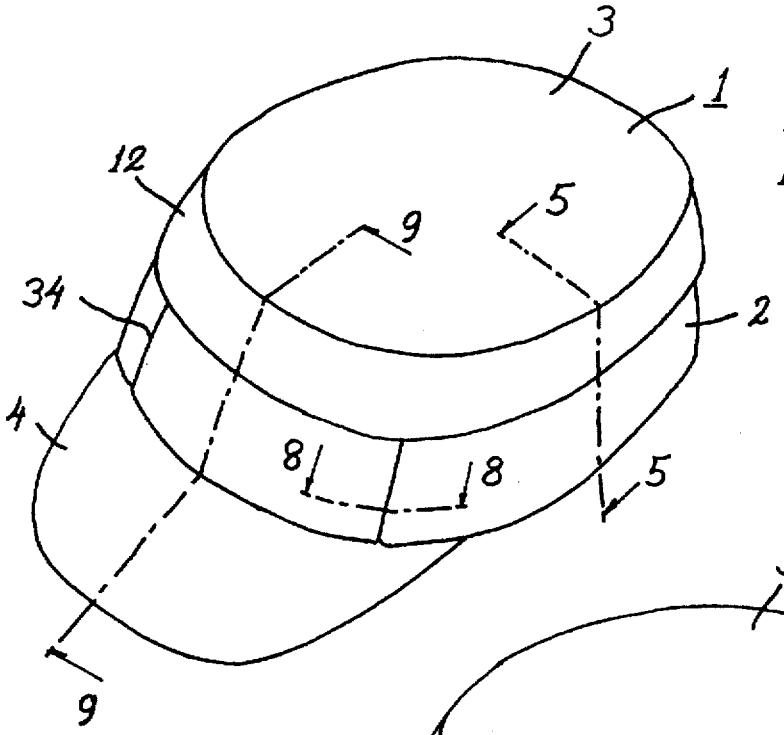
FIG. 1 is a front perspective view of the protection headgear according to the invention.
Figure 2:
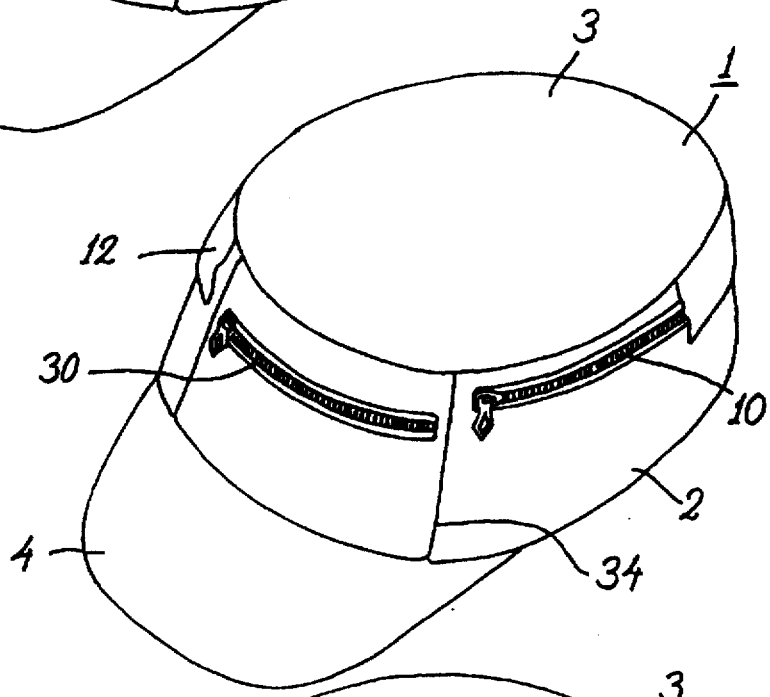
FIG. 2 is a front perspective view in accordance to the FIG. 1, now partly sectioned.

In the FIG. 1 the protection headgear according to the invention has generally been identified by the number 1. In this embodiment the protection headgear 1 may be thought to comprise three main parts; a mantle part 2 which surrounds the wearer's head, this part's main form being cylinder or truncated cone, a top part 3 at the highest, and a vizor 4. In the embodiment shown in the FIG. 1, a band 12 surrounds the upper part of the mantle part 2, from the top part's 3 outer edge downwards. The band 12, which is fixed to the protection headgear only along its upper edge, conceals below it a zipper 10 and 30 (see FIG. 2) making it possible to handle the zippers because of the free lower band edge. The band 12 in the embodiment of the FIGS. 1 and 2 has two tasks; to perform as a shelter that hinders e.g. rainwater from entering through the zippers' 10, 30 area into the inner structures of the protection headgear, as well as to perform as a means that hides the zippers 10, 30 out of sight. Of course, without departing from the idea of the invention, the band 12 may be left off wholly from the structure of the protection headgear 1, when it is seen justified for e.g. cost reasons.

Figure 3:
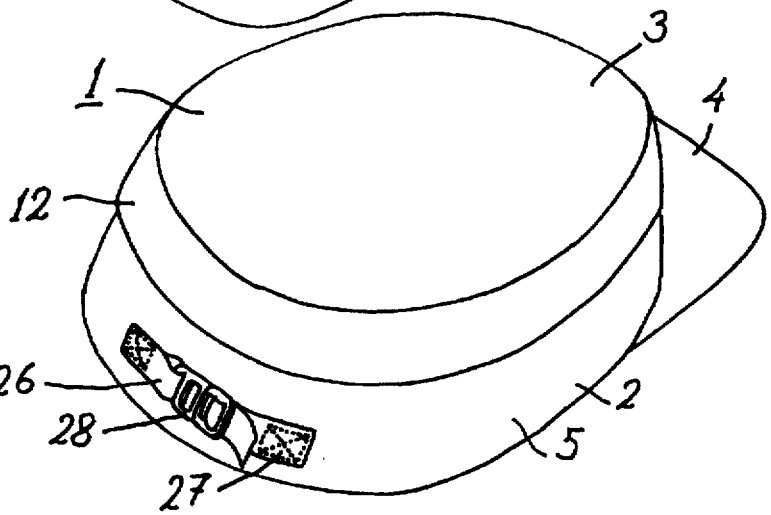
FIG. 3 is a rear perspective view of the protection headgear according to the invention.

In the FIG. 3 there is seen in the field in itself known arrangement for size adjustment of the headgear 1. In the embodiment shown in the figure, two strips 26, 27 have been sewn on the outer fabric 5 at the rear of the headgear 1 in the area of the mantle part 2, one strip 26 being fastened to fixed member of a buckle means 28 and the other 27 being adjustable on the adjusting member of the buckle means 28. By adjusting in itself known way the buckle means the size adjustment of the headgear 1 is achieved. Another means departing from the aforementioned one but still in itself known to accomplish the size adjustment of the headgear is shown in the FIG. 4. In this example an elastic strip 29 has been sewn on the outer fabric 5 on the fabric's inside (or on one of the inner fabric layers), the strip because of its elasticity trying to make the size of the headgear smaller, i.e. trying to reduce the circumferential measure of the mantle part 2, and because of the elasticity being able to stretch so that the circumferential measure of the mantle part 2 exactly corresponds to the size of the wearer's or user's head.

The afore described means 2–28 and 29 for size adjustment of the headgear 1 may be sufficient to state herein in the fact that all in themselves by professionalists known means for size adjustment may be used in connection with the protection headgear 1 of the invention.

In the FIG. 4 there is sown such an embodiment of the top part 3 that the top part 3 is not made up of one flat part, as is the case of the example in the PIGS. 1–3, but of four sector portions 31 sewn up to each other. By the arrangement of the sector portions 31 the top part 3 gets, when desirable, such a feature that it is more like a dome than a flat surface, wherein it may easier conform to the shape of the user's head. When using sector portions 31 or the like, the number of the portions may be other than four, e.g. 2–6 pcs.

Referring now to the FIG. 5, the detailed structure of the protection headgear is to be taken into examination to describe those specific features that make the headgear 1 a protection headgear. In the FIG. 5 the mantle part's 2 outermost fabric layer has a reference number 5, and the top part's 3 outermost fabric layer has a reference number 6 (the actual material of the fabric layers 5 and 6 corresponds to the relevant need, also fur and leather may be used). An intermediate fabric 8 has been stitched along a seam 7 to the fabric 5 along the latter's lower edge, the upper edge of the fabric 8 having been stitched along seam 9 to the edge of the fabric 6. The seam 9 fastens also the upper half of the zipper 10 to the edge areas of the fabrics 8 and 6 while the lower half of the zipper 10 is fastened by a seam 11 to the upper edge area of the fabric 5. Along the seam 9 may also be stitched in its place the afore-mentioned band 12, which, while extending downwards, covers the zipper 10 and which as an example has shown to be made up of its fabric material by twofolding it and by providing its lower edge with a stiffening stitched seam 13.

From the description above and from the FIG. 5 it is seen that between the fabrics 5 and 8 there arises a pocket member or compartment 14 that can be opened and closed by the zipper 10. Now, in the protection headgear according to the invention, a protection mantle 15 has been placed inside the pocket member 14. In the embodiment just being described the general form of the protection mantle 15, as it is while being inside the pocket member, is also shown in the FIG. 6.

A more detailed sectional structure of the protection mantle 15 is shown in the FIG. 7. In this embodiment, the protection mantle 15 consists of a outer fabric surface 16, 17 which by seams 18, 19 has been stitched closingly (at last by the seam 19 after the inner parts have been inserted into their place) to form a bag-like member. This bag-like member includes the protection headgear's protective or covering layers. The protective layers, which in the FIG. 7 have been marked by the numbers 20–24, lie inside the bag-like member in an overlying manner and by their number as many as is needed to achieve the desired protection against e.g. bullets and/or splitters and the like.

From the FIG. 7 it may further be noticed that the bag-like member 16, 17 includes a damping or shock absorbing layer 25 below the layers 20–24 or mainly nearest to the user's head.

At this stage it must be stated that the seam 18 shown in the FIG. 7 is of course not a necessary feature or part of the invention; The seam 18 may be dropped away (or alternatively the seam 19) and replaced by a continuous fold of the fabric 16, 17 in the case it is possible due to the design of the headgear 1.

The task of the protective layers 20–24 is to hinder the penetration there of by bullets, splinters and the kind of projectiles. The layers 20–24 are thus characterized by a very high penetration strength and a high ability to absorb energy while they are at the same time lightweight and flexible ones. As examples of materials available at the moment can be mentioned woven or non-woven Kevlar$_R$-fabrics or fabric cloths or layers, or film/foil materials as Spectra Shield$_R$. The different layers 20–24 may consist of same kind of material among each other, or they may be a combination of different kinds of materials whose combined elect creates the wanted characteristics against the impact of bullets, etc. The marking of the layers 20, 21 and 24 with an unbroken line and the layers 22, 23 with a broken line is made only for reference and to clarify the FIG. 7 (as well as e.g. The FIG. 9), and the differences in the line types need not indicate a difference in the layers'materials. Furthermore, though in the FIG. 7 (as well as in the FIG. 9) there are shown five layers 20–24, this does not mean that the number of the layers were exactly the aforementioned five, but there may exist more or less of the layers. The present development stage of the materials in the layers 20–24 calls for a great number of thin layers 20–24.

The task of the damping layer 25 is to extend the impact energy, coming from a bullet, splitter, etc, stopped by the protective layers 20–24, to a larger area than only that of the hitting point. The aforementioned task of the layer 25 determines the demanded characteristics of the damping layer. As suitable materials can be mentioned e.g. closed cell elastomers provided with the necessary strength characteristics. As an example of materials available nowadays can be mentioned $Airex_R$. The extension of the impact energy may further be improved by positioning one or some of the damping layers 25 also between the different protective layers 20–24. It is possible, too, to install one or some of the protective layers as a final penetration barrier next to the user's head, to be on the safe side if the preceding (with respect to the projectile's advancing direction) protective and damping layers happened to fail or function improperly.

In this context it has to be stated that as the protective layers 20–24 stop a ballistic projectile, the hitting area is encountered by a "hammer-like" blow. The task of the damping layer 25 (or layers 25 if there are many of them) is to broaden or extend the effect of this blow to as large area as possible in order especially in the case of the head, avert a skull breakage. After the hit by a projectile and the latter's stop at the layers 20–24 the user must of course always seek out a medical examination and possibly medical care just in case of a concussion. In such an extreme case that there would occur a breakage at the hitting area this has to be considered as a less dangerous event than the projectile's penetration through the skull's bones into the area of the user's most sensitive organs.

Figure 8:
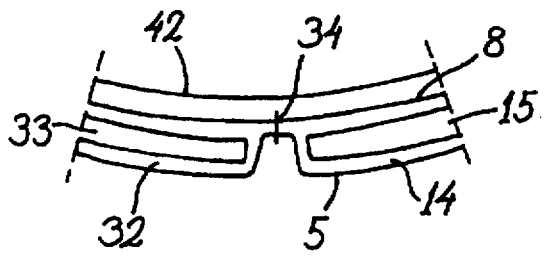
FIG. 8 is a detail sectional view, seen in the direction of the arrows C—C in the FIG. 1 and in a slightly enlarged scale.

Referring to the FIG. 5 (and the FIG. 2) there was already mentioned the pocket member 14 closed by the zipper 10. The zipper 10 and the pocket member 14 may extend around the whole circumference of the mantle part 2. However, as is seen in the FIG. 2, e.g. the forehead area of the headgear may be provided with a separate zipper 30 of its own and with a pocket member 32 closed by that zipper (see also the FIGS. 6, 8 and 9), into which pocket member a protection mantle 33 may be placed, while the structural arrangement of the latter may be essentially the same as was described referring to the FIG. 7 concerning the protection mantle 15. It is seen from the FIGS. 2 and 8 that a seam made up of stitch 34 separates the pocket members 14 and 32 from each other. Such a drawback that at the area of the stitches 34 the protection established by the protection mantles 15, 33 is discontinuing, enabling penetration of projectiles at that area, may be removed by arranging the pocket member 32 in such a manner that it at its end areas reaches on top of the pocket member 14 (or alternatively the end part of the pocket member 14 reaches on top of the pocket member 32), as is seen in the sectional view of the FIG. 10. The overlapping arrangement of the pocket members 32, 14 as described is possible to carry out therefore that all the materials in the area are flexible and pliable.

Figure 9:
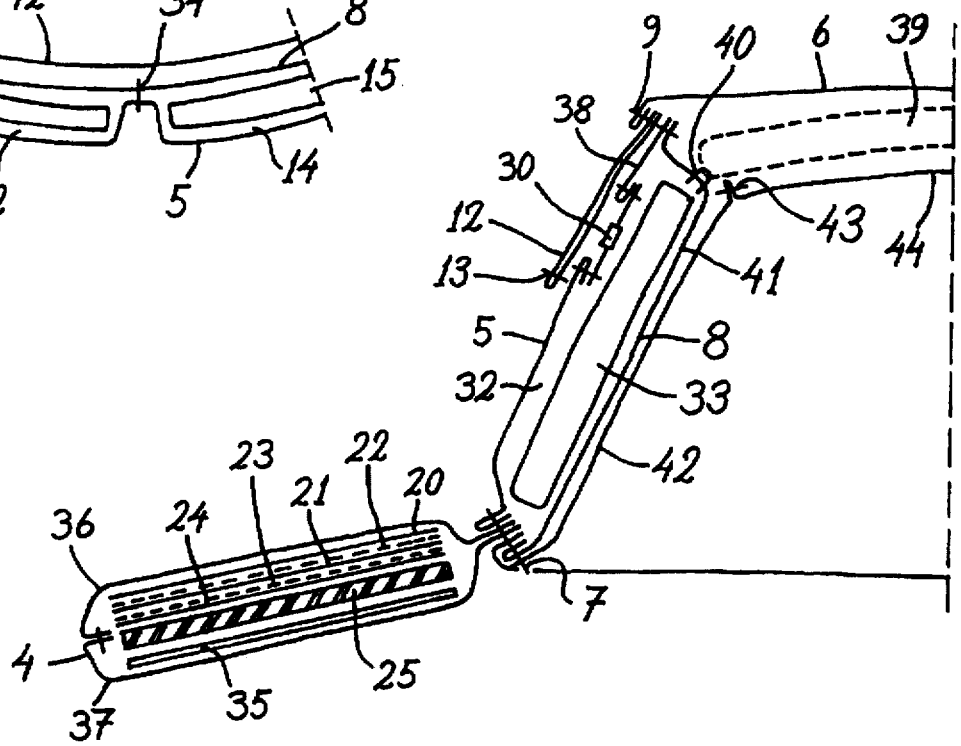
FIG. 9 is a detail sectional view, seen in the direction of the arrows D—D in the FIG. 1 and in a slightly enlarged scale.
Figure 10:
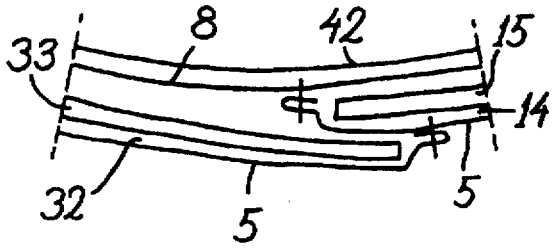
FIG. 10 is a detail sectional view like the FIG. 8, but now of a modified embodiment.

In the FIG. 9 it is seen how the vizor 4 may include protective layers 20–24 and a damping layer (or layers) 25 inside a pocket-like member made up of fabrics 36, 37. The layers 20–24 will now effectively protect the user's face against projectiles coming from the top and front directions. When desired, the vizor 4 may further'include a supporting stiffener 35 as is known by the professionals. From the FIG. 9 it is further noticed that the zipper 30 has been placed at a lower position away from the seam made up of the stitch 9 by the help of a strip 38. The strip 38, if so wanted, may be dropped off so that the zipper 30 will become positioned like the zipper 10 in the FIG. 5, or as well; the zipper 10 may be positioned in the structure like the zipper 30 (FIG. 9).

Referring now to the description related to the FIGS. 1–10 it is now clear how with the help of the'protective layers 20–24 and the damping layer (or layers) 25 there is achieved protection for the headgear's user against the effect of bullets, splinters and the kind of projectiles in the region of the mantle part 2 and in the region of the forehead and eyes, i.e. in the upper region of the user's face, by the help of the protective and damping layers 20–25 arranged, too, into the vizor 4. At the basis of all mentioned before it is analogically clear that also the area of the top part 3 may be protected by providing that part with a protection mantle 39, which is shown in the FIGS. 5 and with broken lines. Naturally, the protection mantle 39 may consist of a bag-like member which includes the protective and damping layers 20–25. Corresponding the zipper 10 and/or 30 also the outer fabric 6 of the top part 3 may be, if so wanted, provided with a zipper (not sown in the figures) which enables the positioning and removing of the protection mantle 39. Further, by using in the arrangement of the protection mantle's 39 bag-like member the same kind of structure as is shown in the FIG. 4 as to the sector-shaped portions 31, a dome-like part (instead of a flat one) may be made of the protection mantle's 39 bag-like member that may more precisely conform to the shape of the user's head.

In the embodiment just described, each of the protective layers 20–24 an the damping layer 25 may be arranged from several separate sector portions, or the layers 20–24 and 25 consist of only one sector portion which is formed by removing a slender wedge-shaped sector portion from the part of a full (360°) circle. When the layers 20–25 are arranged from sector-like portions it may further be advantageous to bind by a stitch or stitches, at the center 70 of that circle which corresponds the sector portions, the opposite outer fabrics of the bag like member of the protection mantle 39 together in order for the protection mantle 39 to maintain always its dome-like (or shallow cone) shape.

In order to keep the protection mantle 39 (FIGS. 5 and 9) in its right place in the protection headgear 1 it may be advantageous to fix the mantle's pocket member fabric with a few stitches 40 to the top part fabric 6 or to the intermediate fabric 8. Especially, as is seen in the FIG. 9, it is also possible to fix the protection mantle 39, when it has a deeper dome or cone shape, from the outer edge's area to the intermediate fabric 8 at the region 41 that is situated at a lower position than the upper edge of the protection mantle 33 (or 15). In the arrangement just described there will be left no region between the protection mantles 15, 33 and 39 without protection, which regions would allow a projectile penetration.

In the sectional views of the FIGS. 5, 8, 9 and 10 it is additionally seen that the protection headgear may further consist of an inner lining 42 next to the user's head, and the lining may consist of a top lining part 44, the latter being formed of one or more pieces and stitched to the lining 42 by a seam 43.

Figure 11:
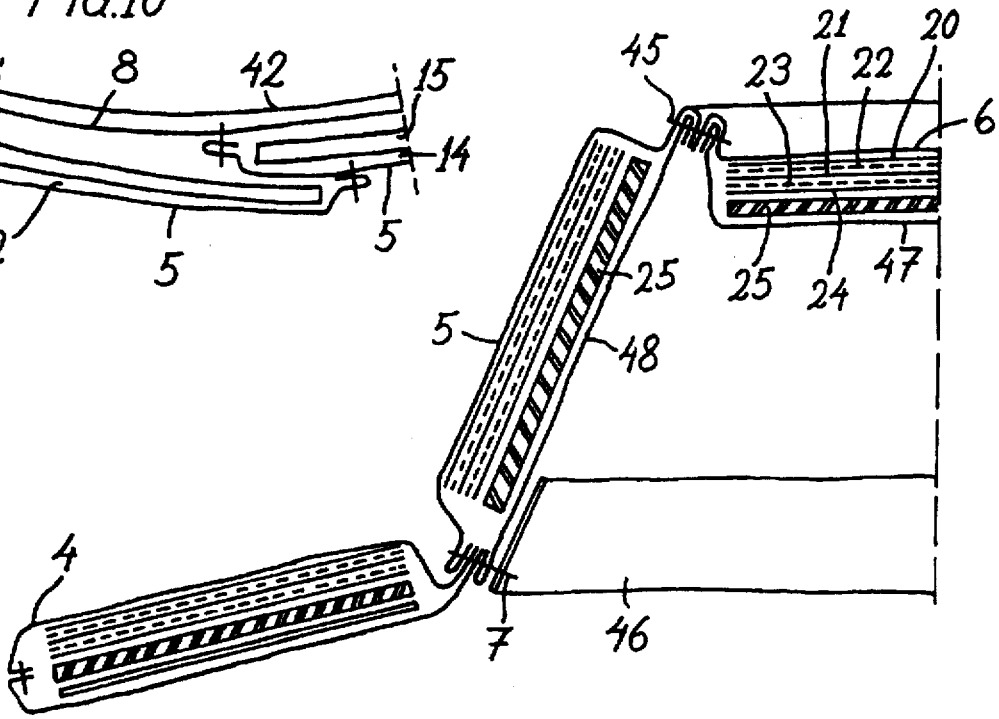
FIG. 11 is a detail sectional view like the FIG. 9, but now of a modified embodiment.

As is seen in the FIG. 11, the protection headgear 1 according to the invention may also be composed so that the protective and damping layers 20–25 are not arranged inside separate pocket or bag-like members, but the layers 20–25 have been arranged directly in a pocket member which consists of an outer fabric 5 and a fabric 48, the fabrics being joined together at their lower and upper edges by stitches 7, 45. This arrangement may be defined as well so that the fabrics 5, 48 establish a pocket-like positioning room for the protective and damping layers 20–25 and, at the same time, act as the protection headgear's outermost cover fabric and as the innermost fabric next to the user's head. The just described arrangement of the outermost cover fabric and the innermost fabric next to the user's head, has been carried out in the embodiment of the FIG. 11 also in the area of the top part 3 with the help of the fabrics 6, 47.

In the embodiment shown in the FIG. 11 the structure of the protection headgear has also been simplified so that the separate inner lining fabrics (which in the FIG. 9 were noted by reference numbers 42, 44) have been dropped away, but without departing from the idea of the invention may even the arrangement of the FIG. 11 be provided with the inner lining fabrics just mentioned. In the FIG. 11 there is seen, too, a sweat band 46 that, when desired, may be arranged to the headgear of the invention. A structural part that corresponds the sweat band 46 may be arranged into the protection headgear by folding one or some of the fabrics 5, 8, 42, 48, 61 inwards and upwards and by providing this fold with the necessary width.

In the FIGS. 12–15 there is shown an embodiment of the protection headgear 1 that comprises special additional protection means 49 and 50. From the FIGS. 12 and 14 it is seen that the additional protection means 49, 50 may normally situate in an upwards folded position. The folding operation is allowed by hinge areas 51 and 52 which are simply areas defined by e.g. stitches 55, 56 in the outer fabrics 53 and 54 of the additional protection means 49, 50, the areas not including protective and damping layers 20–25 (the last mentioned layers, in spite of their flexibility, do not allow very sharp bends of their material in order to be at the same time effective in their main task; as the protection against projectiles).

Figure 12:
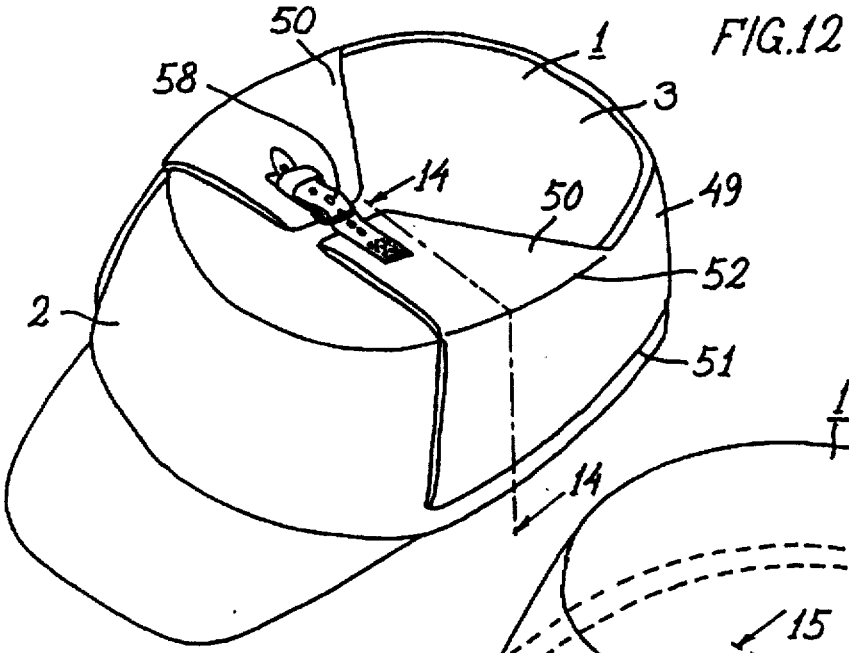
FIG. 12 is a front perspective view of the protection headgear according to the invention, provided with foldable additional protection means.

In the embodiment shown in the FIG. 12 the additional protection means 49, when folded up, surrounds the mantle part 2 at the sides and at the rear, while the additional protection means 50 may situate on the top part 3. The additional protection means 49, 50 may be fixed in their upper position by means known among the professionals, e.g. by strip-buckle arrangement 58 (FIGS. 12–15) or by snap joints, hook and loop fasteners, or by laces.

Figure 13:
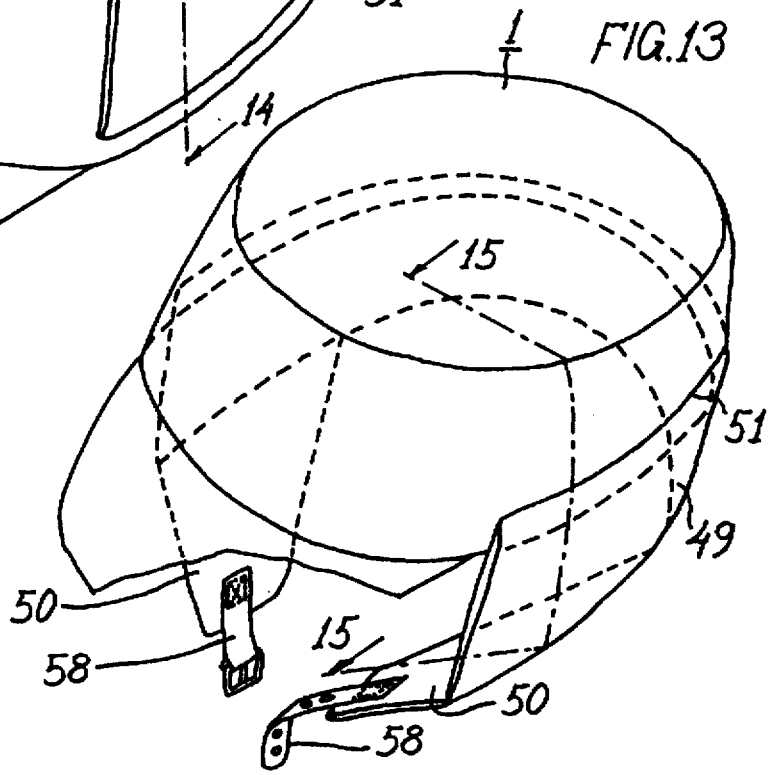
FIG. 13 is a partly sectioned view of the protection headgear of the FIG. 12, additional protection means folded downwards.

From the FIG. 13 it is seen that the additional protection means 49, 50, when folded down, situate on the user's temples, ears, neck and cheeks. The afore-mentioned fixing arrangement 58 may now act as a chin band for securely fixing the additional protection means 49, 50 in the right wearing position as well as the whole protection headgear 1 on the user's head.

Figure 14:
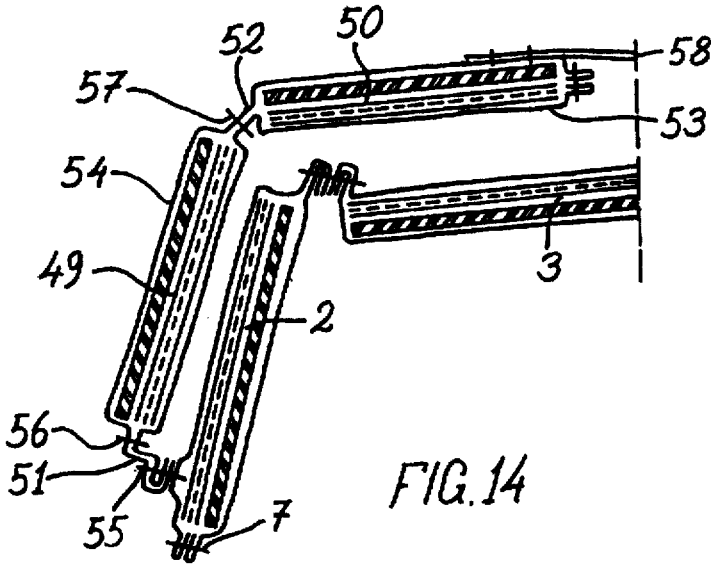
FIG. 14 is a sectional view, seen in the direction of the arrows E—E in the FIG. 12 and in a slightly enlarged scale.

In the sectional views of the FIGS. 14 and 15 the different structural members have only three protective layers and one damping layer 25 in order to make the FIGS. more clear, but here (as well as in other embodiments) as to the number, quality and positioning of the layers, is in effect what was said about those layers earlier in connection with the FIG. 7. Now (FIGS. 14 and 15) it can be especially noticed that the damping layer (or layers) 25 of the additional protection means 49, 50 has been positioned with respect to the protective layers 20–24 so that the damping layer 25 situates next to the user's head when the additional protection means 49, 50 are in their lower (FIG. 15) position. Further it is seen in the FIGS. 14 and 15 that it may be advantageous to arrange the stitched seam 55, which fixes the additional protection means 49, 50 to the mantle part 2 of the headgear 1, slightly above the lower edge area of the mantle part 2 or above the seam 7 in order to leave no intermediate space between the protective and damping layers 20–25 of the mantle part 2 and the corresponding layers of the additional protection means 49, when the additional protection means 49 is folded down (FIG. 15). In another words, there is double the number of protective and damping layers 20–25 in the region of the hinge area 51.

In the FIGS. 16–18 there is shown an embodiment of the protection headgear where the shape of the headgear is approximately a deepened sphere calotte that comprises six sectors 59. The number of the sectors 59 is of course given only as an example, and the real number depends on the material characteristics and manufacturing costs of the protective and damping layers in the sectors. As is seen in the FIG. 17 that shows a simplified connection between adjacent sectors 59 with a seam 60, each sector 59 includes between the outer fabric 5 and the inner fabric 61 a damping layer (or layers) 25 near the user's head and the necessary amount of protective layers 20–24 outside the layer 25. It can further be seen in the FIG. 18 that the just described protective headgear may, too, easily be provided wit additional protection means 62 which in the FIG. 18 are shown in their upwards folded position. The means 62 are kept in upper position and joined together by an adjustable connection means 58 known by professionals. The additional protection means 62, analogically with respect to the arrangements of the FIGS. 12–15, which means 62 may be folded down and fixed together by a fixing arrangement 58 below the user's chin, include of course the protective and damping layers 20–25. The additional protection means of the FIG. 18 protect, when folded down, the areas of the user's temples, ears and cheeks. If there is a need for more protection in the neck area, the rear edges of the additional protection means 62 may be joined by another additional protection means surrounding the rear portion of the headgear 1 and situated between said rear edges of the means 62 in the same manner as the additional protection means 49 of the FIG. 12.

In the FIG. 19 there is shown an embodiment of the protection headgear 1 where the shape of the headgear is created by three separate, while free on to a plane leveling portions 63, 64 and 65. When the portions 63, 64 and 65 are fixed together in the headgear 1 by stitched seams 66 and 67, it may be noticed from the FIG. 19 that the main form of the portions 63–65 is either a part o a cylinder or cone surface. Naturally each of the portions 63, 64 and 65 includes the protective and damping layers 20–25. When desired, the embodiment of the protection headgear 1 of the FIG. 19 may of course be provided with the additional protection means 49, 50, 62 to protect the user's temples, ears, cheeks and neck, as was described in connection with the FIGS. 12–15 and 18.

In the description made with reference to the FIG. 15 there was mentioned the danger that a projectile could penetrate the protection headgear 1 in the seam areas between the structural parts of the headgear, and that this danger could be removed by doubling the amount of the protective and damping layers in the seam areas. In the FIG. 20 there is an example how the doubling may be realized in the size adjustment area at the back of the headgear. In this example, the end portions of the size adjustment means in the mantle part 2 (which includes the protective and damping layers) are not connected together with stitched seams but are overlappingly positioned in the region which is marked with the number 68. The overlapping feature in the region 68 removes the unprotected area in the seam region. Locking of the size adjustment means is made in the FIG. 20 by a hook and loop fastener, as an example.

The danger of projectile penetration in the stitched seam regions was also mentioned in conjunction of the embodiment of the FIG. 9 (compare the area 41 in the FIG. 9). More generally, it can be stated that the danger of penetration also exists in the stitched seam regions of the embodiments of the FIGS. 16–19. Now, it has to be stated that the aforementioned doubling of the protective and damping layers 20–25 in the dangerous seam regions may always be realized in the manner that two different kinds, as to the seam construction, of embodiments of the protection headgear 1 are joined together to form one and same protection headgear 1. The aforementioned indicates that inside e.g. the structural arrangement of the FIG. 11 there may be located the structural arrangement of e.g. the FIGS. 16, 17 (excluded of course the doubling of the vizor 4) to form one protection headgear 1. In the arrangement just described, the damping layer (or layers) 25 of the outer structure (e.g. FIG. 11) may wholly be dropped away and only the inner structure (e.g. FIG. 17) may be provided with the damping layer (or layers) 25. By doing 'this the total thickness of the structure remains reasonable. The double structure just described leaves in the protection headgear 1 at the highest only crossing points of stitched seam regions, necessarily not even those. It is clear that the just described double-joining may be realized amongst all the embodiments explained before.

At last, here is to be stated that the examples of stitched seams and seam regions are really examples only and aimed to show that the structures can be realized. The final stitched seam constructions depend on many factors, among them e.g. labor costs, fabric quality (e.g. stiffness/elasticity) and thickness, desired durability of the seams, appearance, available sewing machines, etc. Further it has to be stated that it is possible in all the embodiments of the protection headgear 1 to provide the protective and damping layers 20–25 with a bag-like member in all parts that make up the assembly, or the layers 20–25 may directly be placed between the headgear's outer and inner fabrics.

I claim:

1. A protection headgear against the penetration and effect of ballistic projectiles, comprising protection structures against the penetration and effect of projectiles, which structures are softly flexible, the protection structures consisting of several protective layers (20–24) with a high penetration strength and being mainly composed of fabric material, and of at least one damping layer (25) being composed of flexible material which is closed cell material, the protection structures (20–25) being situated in the protection headgear (1) at least at the front, sides and rear, the protection structures (20–25) being situated in bag-like members to form protection mantles (15, 33, 39), the surface material of the bag-like members being able to form an outer and inner surface material (5, 6, 53; 48, 47, 54, 61) of the protection headgear (1), the protection headgear (1) comprising a vizor (4) which includes the protection structure (20–25).

2. A protection headgear according to claim 1, wherein the protection headgear (1) comprises as its main parts, when the vizor (4) is left outside the examination, which parts include the protection structure (20–25) and are interconnected with each other by stitched seam regions, a mainly truncated cone shaped mantle part (2) and a mainly even top part (3).

3. A protection headgear according to claim 1, wherein the protection headgear (1) comprises as its main parts, when the vizor (4) is left outside the examination, which parts include the protection structure (20–25) and are interconnected with each other by stitched seam regions, a mainly deepened sphere callotte which is composed of mainly sector-like portions (59).

4. A protection headgear according to claim 1, wherein the protection headgear (1) comprises as its main parts, when the vizor (4) is left outside the examination, which parts include the protection structure (20–25) and are interconnected with each other by stitched seam regions, at least three mainly cylindrical portions (63, 64, 65).

5. A protection headgear according to claim 1, wherein the protection headgear (1) is provided with additional protection means (49, 50, 62) which include the protection structure (20–25) and which are able to situate alternatively in an upwards folded position (FIGS. 12, 14, 18) and in a downwards folded position (FIGS. 13, 15), protecting in the latter position the protection headgear's (1) user's temples, ears, cheeks and neck.

* * * * *